United States Patent [19]

Paulet

[11] 4,018,628

[45] Apr. 19, 1977

[54] PROCESS FOR COLORING ALUMINIUM

[75] Inventor: Jean François Paulet, Siblingen, Switzerland

[73] Assignee: Swiss Aluminium Ltd., Neuhausen am Rheinfall, Switzerland

[22] Filed: Oct. 17, 1975

[21] Appl. No.: 623,480

[30] Foreign Application Priority Data

Oct. 18, 1974 Switzerland ..... 13993/74
Oct. 7, 1975 Switzerland ..... 12997/75

[52] U.S. Cl. ..... 148/6.27; 427/436
[51] Int. Cl.² ..... C23F 7/00; C23F 5/02
[58] Field of Search ..... 148/6.27; 427/436

[56] References Cited

UNITED STATES PATENTS 2,554,256 5/1951 Lewis et al. ..... 148/6.27

FOREIGN PATENTS OR APPLICATIONS 44-8338 4/1969 Japan ..... 148/6.27
44-23204 2/1969 Japan ..... 148/6.27

OTHER PUBLICATIONS

Fishlock, Metal Colouring, pp. 351, 353, Robert Draper Ltd., 1962.

*Primary Examiner*—Ralph S. Kendall
*Attorney, Agent, or Firm*—Ernest F. Marmorek

[57] ABSTRACT

The invention allows one to obtain a strongly adherent dark grey to black coating, with good corrosion resistance, on aluminium and its alloys. The degreased aluminum is pre-treated in an aqueous solution containing at least one salt of a metal which is less electronegative than aluminium. It is then colored in another aqueous solution containing molybdate ions and at least one fluorine compound and/or a heavy metal chloride, and/or an organic chlorine compound with active chlorine atoms.

13 Claims, No Drawings

PROCESS FOR COLORING ALUMINIUM

The invention concerns a process for colouring aluminium and its alloys dark grey to black.

Processes for colouring aluminium black are known, whereby the colouring solutions are based on ammonium molybdates and ammonium chloride. On the coatings obtained from these processes however there is a powdery, dark grey deposit and the bond strength of the coatings is low with the result that they come away easily if the aluminium is slightly deformed. Furthermore, these processes can not be used for certain aluminium alloys.

The aim of the invention presented here is therefore to provide a process for the production of dark grey to black layers which are strongly adherent, are uniform in appearance, exhibit good corrosion resistance, and by which process the above mentioned disadvantages and limitations are removed.

This objective is achieved by the invention in which the surface of the metal is pre-treated in an aqueous solution containing at least one salt of a metal which is less electro-negative than aluminium, and is then coloured in another aqueous solution containing molybdate ions and an addition of at least one fluorine compound and/or a heavy metal chloride and/or an organic chlorine compound with active chlorine.

This process offers the following advantages:

The compact and strongly adherent layer can be coloured reproducibly in all colour tones from dark grey to black.

The process can be used successfully for aluminium and all aluminium alloys.

The corrosion behaviour is surprisingly better than that exhibited by the same layers produced by another method e.g. by an alkaline or acidic chromate treatment process.

Prior to the colouring stage, the metal surface is degreased and then pre-treated with an aqueous solution which contains at least one salt of a metal which is less electronegative than aluminium. In particular, the elements iron, copper, nickel, manganese, zinc, tin or chronium are employed as the metallic components of such salts. The solution for the pre-treatment may be either alkaline or acidic.

The following compositions (wt.%) have been found to be particularly advantageous for the chemical pre-treatment of metallic surfaces:

An aqueous solution at 50° – 95° C, preferably 85°–95° C, containing 2–15%, preferably 9–11% iron-III-chloride ($FeCl_3 \cdot 6H_2O$) and 0.1–5%, preferably 0.4–1% sodium fluoride (NaF). The duration of the pre-treatment is 1–2 min.

An aqueous solution at 18°–25° C, preferably 20°–23° C, which contains 0.5–10%, preferably 1.5–2.5% zinc oxide (ZnO), 2.5–50%, preferably 8–12% sodium hydroxide (NaOH), 1.5–30%, preferably 4–6% sodium potassium tartrate ($KNaC_4H_4O_6 \cdot 4H_2O$), 0.1–1%, preferably 0.2% iron-III-chloride, and 0.002–2%, preferably 0.1% sodium nitrate ($NaNO_3$). The etching time is 0.25–3 min. in particular 0.5–2 min.

An aqueous solution at 40°–70° C, which contains 2–10% tin chloride $SnCl_2 \cdot 2H_2O$), 5–20% sodium-potassium tartrate and 0.5–3% sodium hydroxide, and with which the metal surface is etched for 1–5 minutes.

The chemical pre-treatment produces a surface activation which in turn permits more rapid and more uniform coloring.

A molybdate or a heptamolybdate of ammonium and/or of the alkaline metals is used for the preparation of the molybdate ions containing aqueous solution for colouring aluminium and aluminium alloys.

Fluorine compounds with active fluorine atoms e.g. sodium fluoride, fluoroborate, fluorosilicate, are used preferentially as further constituents of the colouring solution.

The heavy metal chlorides which come into consideration too are usefully chlorides of the metals, nickel, chromium, iron, tin, copper an/or manganese. Aminochlorhydrates for example can be used as an organic chlorine compound with active chlorine atoms.

The aqueous colouring solution is normally used warm and is preferably at a temperature of 70°–95° C. In accordance with a preferred further development of the invention it contains 1–10% ammonium heptamolybdate and 0.2–10% of an ammonium salt containing fluorine, in particular 4–6% ammonium heptamolybdate and 1–3% ammonium fluoroborate.

An important further development of the aqueous colouring solution of the invention is that it is stabilised in a pH-range between 4 and 8.5, preferably between 6.5 and 7.5. The stabilising compounds which have given the best results in this respect are the alkaline reacting amines and their derivatives, in particular triethanol amine.

The amount of stabilisor to be added depends on the composition of the colouring solution; it must however, be large enough that the above mentioned pH-range is reached.

This stabilisation allows one to keep to a minimum the loss of ammonia which may be attributed to the effect of heating, and the formation of polymolybdates which are more or less insoluble. They also permit the colouring strength of "lifetime" of the solution, expressed in $m^2$ of surface coloured per liter of solution, to be markedly increased.

The darkness of the colour obtained depends on the pre-treatment used.

The coloured layers can if desired be subjected to a passivating after-treatment in an alkaline chromate, silicate or amine solution.

The dark grey to black layers produced by the process of the invention are particularly suitable for photo-reproduction processes:

A sheet of aluminium which has been provided with a conversion coating of $Al_2O_3$ by any suitable process is coated with a photo-sensitive lacquer. The areas which are later to be coloured black are covered with a negative.

After exposing to light the lacquer can be easily removed from these covered areas whilst the other areas are covered with the lacquer which is polymerised after developing and protect the underlying oxide from being coloured in the colouring process.

The non-protected areas can be etched for example in a caustic soda solution and coloured by the process of the invention. Thus the dark grey to black surfaces can be sharply delineated from those white or differently coloured surfaces which are not attacked in the colouring process, the contrast achieved being of importance for example in the case of inscriptions, and scanning or linear type of imaging.

Other useful possibilities for application of the dark grey to black coatings lie in the fields of architecture and in the construction of heating equipment such as heat exchangers thermal radiators, and solar panels.

Further properties and advantages of the invention are explained in greater detail in the following examples:

The examples 1–3 refer to acidic etching pre-treatments and examples 4 and 5 to caustic etching pre-treatments for the surfaces of aluminium and aluminium alloys.

EXAMPLE 1

A sheet of aluminium alloy containing 1.2% Mn, 0.8% Fe, 0.4% Si and 0.1% Zn was decreased and then immersed for 2 min. in an aqueous solution at 90° C, containing 10% iron chloride and 0.5% sodium fluoride. With this treatment the sheet was covered with a uniform, medium grey coating.

After rinsing in cold tap water the sheet was treated for 4 minutes on an aqueous solution at 90° C, containing 5% ammonium heptamolybdate and 1% ammonium fluoroborate ($NH_4BF_4$). The sheet was subsequently rinsed again in tap water, it then exhibited a matt dark grey, almost black, surface with uniform colour distribution.

The same result was obtained using sheets of many different alloy compositions, and with pure aluminium.

EXAMPLE 2

An aluminium sheet of the same composition as in example 1 was degreased and then immersed for 2 min. in an aqueous solution of the following composition at room temperature:

20% nickel chloride ($NiCl_2 . 6H_2O$)
1% hydrogen fluoride (HF)
2% boric acid ($H_3BO_3$)

After this pre-treatment the etched sheet was coloured under the same conditions as in example 1, the results being the same as in that example viz. a mat dark grey, almost black, surface with uniform colour distribution.

EXAMPLE 3

An aluminium sheet with the same composition as in example 1 was degreased and pre-treated for 2 min. in an aqueous solution at room temperature and containing 5% manganese sulfate ($MnSO_4 . 1H_2O$) and 20% hydrogen chloride. The colouring was carried out in accordance with the conditions stated in example 1 and the same results as in that example were obtained.

Of these three examples the first was most satisfactory with respect to total impression, reaction rate and production costs.

EXAMPLE 4

An aluminium sheet of the same composition as given in example 1 was degreased and then immersed for 30 sec. in an aqueous zincate solution at room temperature, having the following composition:

2% zinc oxide
10% sodium hydroxide
5% sodium-potassium tartrate
0.2% iron chloride
0.1% sodium nitrate The sheet was coated with a uniform, strongly bonding light-grey layer.

The sheet was then rinsed in tap water and coloured using the conditions given in example 1. After rinsing with cold tap water once more, the sheet exhibited a shiny, uniformly black surface.

The same results were obtained using sheets of a large variety of aluminium alloys or pure aluminium.

EXAMPLE 5

An aluminium sheet of the same composition as in example No. 1 was degreased and then immersed for 3 min. in an aqueous tin salt solution at 70° C and of the following composition:

5% $SnCl_2 . 2H_2O$
10% sodium-potassium tartrate
1.3% sodium hydroxide

After rinsing in cold tap water the sheet was then treated for 4 min, in an aqueous solution at 90° C, containing 5% ammonium heptamolybdate and 2% $NiCl_2$. The result was the same as in example No. 4.

EXAMPLE 6

A sheet of aluminium of the same composition as in example 1 was degreased and then immersed for 2 minutes in an aqueous pre-treatment solution of the same composition as in example 4. After rinsing in cold tap water, the sheet was treated for 3 minutes in an aqueous colouring solution at 90° C, which had been stabilised by an addition of triethanolamine and had the following composition:

5% ammonium heptamolybdate,
1.5% ammonium fluoroborate
8% triethanolamine

The pH of the solution was stabilised at a value of 7.

The surface of the sheet was a homogeneous, shiny-black colour.

The "lifetime" of this stabilised colouring solution was of the order of 8 $m^2$ per liter, in contrast to 2 $m^2$ per liter of a solution of the same composition but without a stabilisor.

At this point the colouring solution was exhausted of active ingredients, but was not contaminated by precipitating polymolybdates, so that it was possible without any difficulty to regenerate the solution by a further addition of active ingredients.

What I claim is:

1. In a process for producing a strongly adherent, dark grey to black coating on the surface of aluminum and aluminum alloys, the steps comprising, pretreating said surface in an aqueous solution containing at least one salt of a metal selected from the group consisting of iron, copper, nickel, manganese, zinc, tin and chromium; and forming the coating on the pretreated surface by treating it until the required coloring is obtained, in an aqueous solution stabilized at a pH of from about 6 to about 7.5 with an alkaline amine or amine derivative and containing from about 1% to about 10% molybdate ions and a total of from about 0.2% to about 10% by weight of a salt containing fluoride and/or at least one chloride of a metal selected from the group consisting of nickel, chromium, iron, tin, zinc, copper and manganese and/or an organic chloride compound with active chlorine atoms.

2. A process according to claim 1 in which the triethanolamine is used as the stabilizer.

3. A process according to claim 1 in which the colouring process is carried out in a hot aqueous solution containing 1–10% ammonium heptamolybdate and 0.2 – 10% of an ammonium salt containing fluorine.

4. A process according to claim 3 in which the colouring process is carried out at 70°–95° C in an aqueous solution which contains 4–6% ammonium heptamolybdate and 1–3% ammonium fluoroborate.

5. A process according to claim 3 in which the pretreatment is carried out for 0.25–3 min. in an aqueous solution at 18°–25° C containing 0.5–10% zinc oxide, 2.5–50% sodium hydroxide, 1.5–30% sodium potassium tartrate, 0.1–1% iron-chloride, and 0.002–2%, preferably 0.1% sodium nitrate.

6. A process as claimed in claim 5, wherein the pretreatment is carried out for 0.5–2 min. in an aqueous solution at 20°–23° C which contains 1.5–2.5% zinc oxide, 8–12% sodium hydroxide, 4–6% sodium potassium tartrate, about 0.2% iron chloride and about 0.1% sodium nitrate.

7. A process according to one of the claims 1 in which the colouring process is carried out in an aqueous solution containing at least one chloride of the metals nickel, chromium, iron, tin, zinc, copper or manganese.

8. A process according to claim 1 in which the colouring process is carried out in an aqueous solution which contains amino-chlorhydrates.

9. A process according to claim 1 in which the pretreatment takes place during 1–2 min. in an aqueous solution at 50°–95° C containing 2–15% iron chloride, and 0.1–5% sodium fluoride.

10. A process as claimed in claim 9, wherein the aqueous solution is maintained at 85°–95° C and contains 9–11% iron chloride; and 0.4–1% sodium fluoride.

11. A process according to claim 1 in which the pretreatment is carried out for 1–5 min. in an aqueous solution at 40°–70° C, containing 2–10% tin chloride, 5–20% sodium-potassium tartrate and 0.5–3% sodium hydroxide.

12. A process according to one of the claims 1 in which the coloured coating obtained is passivated in an alkaline chromate, silicate or amine solution.

13. A process as claimed in claim 1, wherein the fluoride salt is a fluoroborate or a fluorosilicate.

* * * * *